US005531318A

United States Patent [19]

Coleman et al.

[11] Patent Number: 5,531,318

[45] Date of Patent: Jul. 2, 1996

[54] HOLDER AND ENCLOSURE FOR A PIECE OF HARD CANDY

[76] Inventors: Thomas J. Coleman, 89 Winding Way Rd., Bristol, Va. 24201; William K. Schlotter, IV, 175 Toluca Rd., Stafford, Va. 22554; Princess A. Coleman, 89 Winding Way Rd., Bristol, Va. 24201; Ann M. Schlotter, 175 Toluca Rd., Stafford, Va. 22554

[21] Appl. No.: 408,963

[22] Filed: Mar. 23, 1995

[51] Int. Cl.[6] ..... B65D 79/00; B65D 85/72; B65D 85/00; B43K 21/02

[52] U.S. Cl. ..... 206/738; 206/385; 426/115; 401/59

[58] Field of Search ..... 206/804, 817, 206/385, 45.14; 426/134, 115; 401/59, 60, 107, 108; 215/3; 220/8, 264, 326; 132/320, 318

[56] References Cited

U.S. PATENT DOCUMENTS

| | | | |
|---|---|---|---|
| 1,801,465 | 4/1931 | Ament | 401/59 X |
| 2,404,815 | 7/1946 | Satz et al. | 401/59 |
| 2,443,361 | 6/1948 | Satz et al. | 401/59 |
| 2,513,830 | 7/1950 | Voegeli | 401/59 |
| 2,610,732 | 9/1952 | Calhoun | 401/59 |
| 2,960,259 | 11/1960 | Aveni | 221/279 |
| 3,612,072 | 10/1971 | Fukui | 206/385 X |
| 3,845,882 | 11/1974 | Hass | 221/279 |
| 4,171,753 | 10/1973 | Vreede | 221/197 |
| 4,561,854 | 12/1985 | Amici et al. | 446/304 |
| 4,589,575 | 5/1986 | Rigberg et al. | 221/198 |
| 5,170,904 | 12/1992 | Heuhaus | 220/264 X |
| 5,178,298 | 1/1993 | Allina | 221/24 |
| 5,191,995 | 3/1993 | McDonald | 221/24 |

OTHER PUBLICATIONS

"The Manufacturing Confectioner", Jan. 1986, p. 74.
Advertisements, Topps Co., Brooklyn, NY Dec. 1993.

*Primary Examiner*—B. Dayoan

[57] ABSTRACT

A candy holder and enclosure for a piece of candy. The device includes a main housing and a secondary housing. The secondary housing has an upper end that extends into a lower end of the main housing. The main housing includes a spring loaded split cap that encloses the upper end of the main housing and a hard stick of candy is secured to the upper end of the secondary housing and contained within the main housing. Moving the secondary housing into the main housing pushes the candy upwardly to open the split cap and to expose the candy for consumption. If the candy is not completely consumed, the secondary housing is pulled outward from the main body and the remaining candy will be drawn into the main housing for storage.

9 Claims, 1 Drawing Sheet

HOLDER AND ENCLOSURE FOR A PIECE OF HARD CANDY

This invention is directed to a hand held holder and enclosure for a piece of hard candy which may be any shape such as cylindrical.

Heretofore, various objects have been dispensed from a dispenser or housing which includes pills, small pieces of candy, golf balls, etc., such as the following, U.S. Pat. Nos. 2,960,259; 3,845,882; 4,171,753; 4,589,575; 5,178,298 and 5,191,995. Other patents have been issued which related to devices having snap action opening jaws for some reason. Such a known patent is as follows: U.S. Pat. No. 4,561,854. It is believed that each of the above have a use for their specific purpose which differs from that of the present invention.

It is therefore an object of the present invention to provide a candy holder and dispenser which will protect the candy when not in use and which will provide a holder for the candy when in use.

Another object is to provide a dispenser which can be used to restore the candy for future use, if not all of the candy has been consumed.

Another object is to provide a candy holder and dispenser which is simple to use and has a minimum of operative parts.

The invention will be better understood and other objects and features of the invention will become more apparent from the ensuing detailed description taken in conjunction with the drawings.

DETAILED DESCRIPTION OF THE DISCLOSURE

Figure 3:
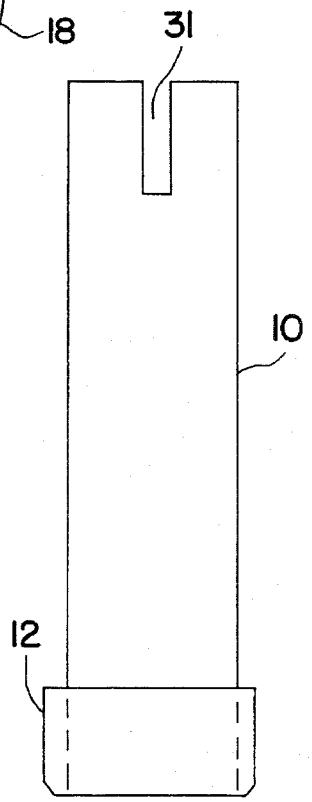
FIG. 3 is a side view of the main housing slots in which push blocks fit when illustrating the enclosure is closed.

Now referring to the drawings there is shown a candy holder and dispenser. The candy holder and dispenser includes a cylindrical main housing 10 for receiving a piece of candy in a stored position prior to being uncovered for consumption. The main housing has a smooth inner surface along a length thereof and is provided with a stop cap 12 at the bottom end. The main housing is provided with a somewhat spherical upper end enclosure which is split along a diameter to form two somewhat semi-spherical halves 16, 18. Each of the semi-spherical halves 16, 18 are secured at their lower surface to a hinge half 20, 22 with another half of each hinge 24, 26 secured to the upper end of the main housing. A spring 28, 30 is also secured to the hinge which applies a spring force on each semi-spherical half with the force in a direction that forces the semi-spherical halves toward each other. Each semi-spherical half is provided with an inwardly protruding push block 32, 34 which is secured to an inside surface of each semi-spherical half. The protruding push blocks fit into a slot 31 in the upper end of the main housing as seen in FIG. 3 so that the enclosure halves are permitted to close together. The push blocks will be explained further hereinafter. The split cap has been shown and described as being semi-spherical. The split cap could be made in two, three or more sections each of which are hinged to the main housing and spring loaded toward an axis of the housing.

Figure 1:
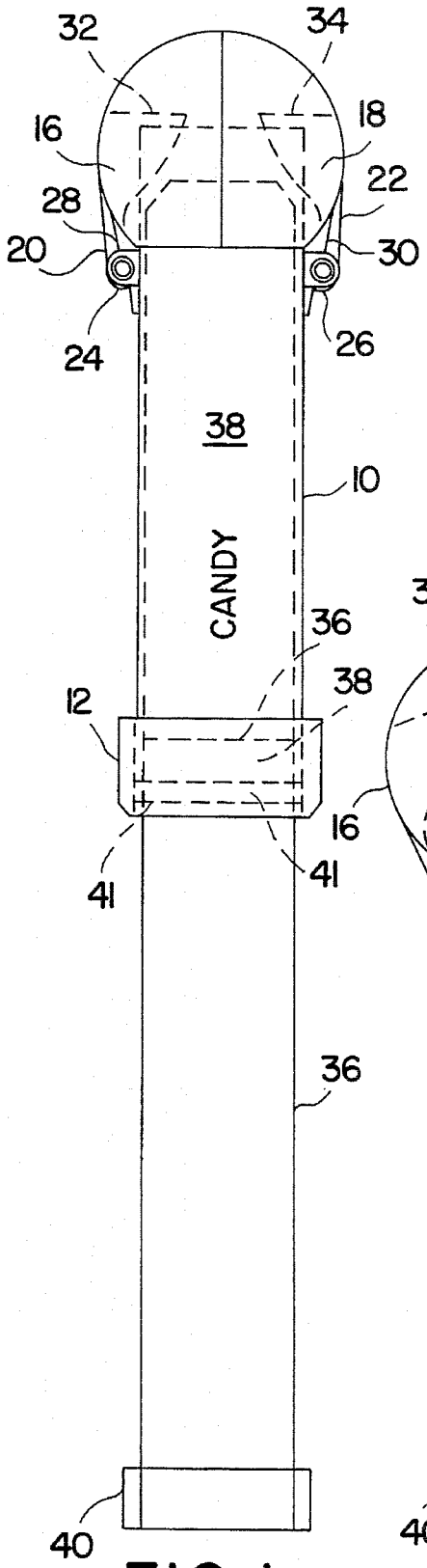
FIG. 1 illustrates a candy holder with a piece of candy therein.

A secondary cylindrical housing 36 is provided which functions as a holder, to which a piece of candy 38 is secured to the upper most end of the secondary housing. The secondary housing has a smooth inner and outer surface along a length thereof and is provided with a cap 40 that fits over the lower end thereof. The upper end of the secondary housing 36 extends a short distance into the bottom end of the main housing and is provided, with a slide tension 0-ring 41 is secured to the upper end of the secondary housing between the lower end of the main housing and the secondary housing as shown in FIG. 1. The tension O-ring 41 fills in the space between the secondary housing and the main housing so that the tension O-ring applies a tension on the upper main housing to secure the main housing in its upper position. The candy that is secured to the upper end of the secondary housing has an initial length such that the entire piece of the candy is contained within the main housing with the upper end of the candy in a region of the hinged end of the split cap.

Figure 2:
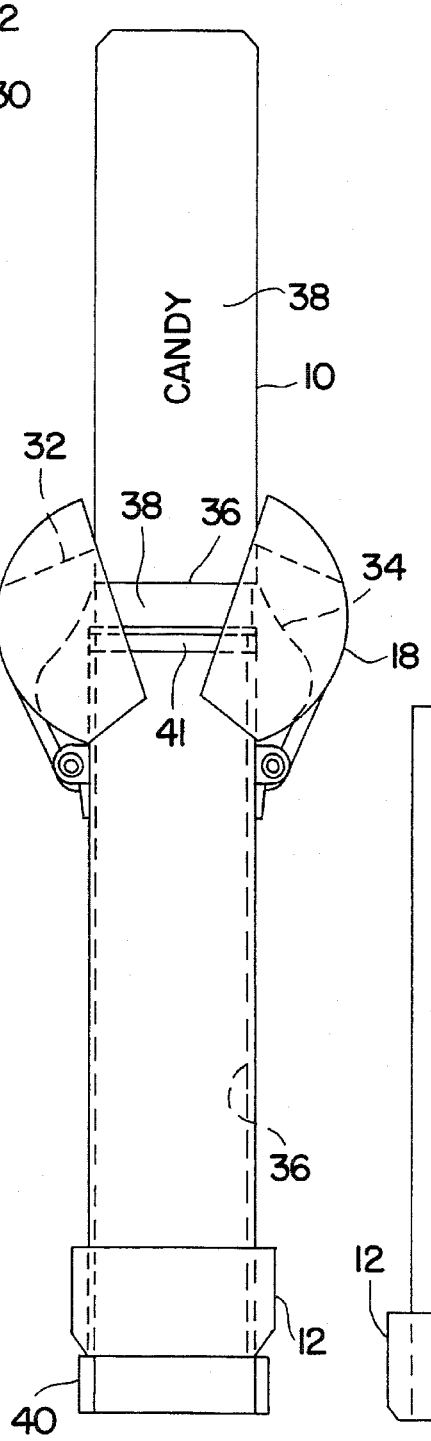
FIG. 2 illustrates the candy holder with a piece of candy exposed for consumption.

FIG. 1 illustrates the candy holder with a piece of candy secured therein in a storage position. In use, the secondary housing is pushed upwardly or the main housing is pushed downwardly, with relative movement of the two housing parts, the candy contacts the push blocks of each split cap half which extend into the slit 31 thereby forcing the split cap parts 16 and 18 outwardly. The top portion of the candy then holds the split cap in an open position. The candy can be pushed upwardly only far enough to expose an upper end for consumption and then pushed upwardly as the candy is consumed. FIG. 2 illustrates the candy in a full up position. In this position as shown in FIG. 2, the main housing has been pushed downwardly until the end cap of the main housing is in contact with the stop cap on the secondary housing. The relationship of the secondary housing to the main housing is such that the inner surface of the main housing has a tight fit with the slide tension ring on the upper end of the secondary housing and has a length such that when the stop cap is in contact with the end cap as shown in FIG. 2, the candy is completely exposed and ready for complete consumption.

Obviously, the candy can be consumed and another piece of candy can be secured to the upper end of the secondary housing for consumption. In the event the entire amount of candy is not consumed, the main housing can be moved up to its normal storage position and the candy will be within and protected by the main housing and the enclosure halves. Since the split cap has been provided with springs that force the split cap halves toward each other, the split cap will close the upper end as the candy is completely withdrawn into the main housing.

The candy holder and dispenser can be decorated in any suitable manner such that the main housing is a persons body and the split cap could be decorated as a head with a large mouth. Thus, the device could be called a monster mouth. Any decorative scheme can be used within the confines of the invention.

Any edges should be made child safe and each end of the spring can be placed within a groove in the main body and in the split cap so that the ends of the spring will not be entirely exposed on an outside surface of the split cap and main body.

The drawings have been shown with dotted lines to illustrate, the different parts within the main housing; however, the housing could be made of clear plastic through which the parts that are contained within the main housing can be seen. Thus, the housing can be made of any suitable material and the candy will be of a hard texture.

What is claimed:

1. A holder and enclosure for an elongated object which comprises a cylindrical main housing having a smooth inner surface along a length thereof, a secondary cylindrical housing having smooth inner and outer surfaces along a length thereof, said secondary housing having one end that fits into a bottom end of said main housing and said one end supports said elongated object, a split cap secured to and enclosing an upper end of said main housing, said split cap being biased in a closing direction by a biasing spring means, and said main housing having a stop cap (12) on a bottom end thereof and said secondary housing having an end cap (40) on a bottom end thereof.

2. A holder and enclosure for a piece of candy as set forth in claim 1, in which said split cap has at least two portions and each of said at least two portions include push blocks on an inside surface thereof that extend toward an axis of said holder and enclosure.

3. A holder and enclosure for a piece of candy as set forth in claim 2, in which said split cap is substantially spherical and has two semi-spherical halves and each semi-spherical half includes push blocks that extend inwardly toward the axis.

4. A holder and enclosure for an elongated object as set forth in claim 1, in which said secondary housing includes a slide-tension-ring on an outer upper end surface thereof which surrounds the upper end of said secondary housing and which is between said main housing and said secondary housing.

5. A holder and enclosure for an elongated object as set forth in claim 2, in which said secondary housing includes a slide-tension-ring on an outer upper end surface thereof which surrounds the upper end of said secondary housing and which is between said main housing and said secondary housing.

6. A holder and enclosure for an elongated object as set forth in claim 3, in which said secondary housing includes a slide-tension-ring on an outer upper end surface thereof which surrounds the upper end of said secondary housing and which is between said main housing and said secondary housing.

7. A holder and enclosure for an elongated object as set forth in claim 2, in which said main housing has oppositely disposed linear slits in an upper end along a portion of a length thereof, and each of said push blocks on said split cap extend inwardly and fit within one of said linear slits.

8. A holder and enclosure for an elongated object as set forth in claim 3, in which said main housing has oppositely disposed linear slits in an upper end along a portion of a length thereof, and each of said push blocks on said split cap extend inwardly and fit within one of said linear slits.

9. A holder and enclosure as set forth in claim 1, wherein said elongated object is a piece of candy.

* * * * *